US008604340B2

(12) United States Patent
Jiang et al.

(10) Patent No.: US 8,604,340 B2
(45) **Date of Patent: *Dec. 10, 2013**

(54) COAXIAL CABLE

(75) Inventors: Kai-Li Jiang, Beijing (CN); Liang Liu, Beijing (CN); Shou-Shan Fan, Beijing (CN)

(73) Assignees: Tsinghua Univeristy, Beijing (CN); Hon Hai Precision Industry Co., Ltd., New Taipei (TW)

( * ) Notice: Subject to any disclaimer, the term of this patent is extended or adjusted under 35 U.S.C. 154(b) by 292 days.

This patent is subject to a terminal disclaimer.

(21) Appl. No.: 12/321,569

(22) Filed: Jan. 22, 2009

(65) Prior Publication Data

US 2009/0255706 A1 Oct. 15, 2009

(30) Foreign Application Priority Data

Apr. 9, 2008 (CN) ..... 2008 1 0066299

(51) Int. Cl.
*H01B 9/02* (2006.01)

(52) U.S. Cl.
USPC ..... 174/36; 174/126.1

(58) Field of Classification Search
USPC ..... 174/126.1, 36, 113 R
See application file for complete search history.

(56) References Cited

U.S. PATENT DOCUMENTS

| | | | | |
|---|---|---|---|---|
| 4,132,828 | A | 1/1979 | Nakamura et al. | |
| 4,461,923 | A * | 7/1984 | Bogese, II | 174/36 |
| 7,390,963 | B2 * | 6/2008 | Scherer | 174/36 |
| 7,413,474 | B2 | 8/2008 | Liu et al. | |
| 7,704,480 | B2 | 4/2010 | Jiang et al. | |
| 7,750,240 | B2 | 7/2010 | Jiang et al. | |
| 2004/0020681 | A1 * | 2/2004 | Hjortstam et al. | 174/102 SC |
| 2004/0051432 | A1 | 3/2004 | Jiang et al. | |
| 2004/0053780 | A1 | 3/2004 | Jiang et al. | |
| 2007/0075619 | A1 | 4/2007 | Jiang et al. | |
| 2007/0151744 | A1 | 7/2007 | Chen | |
| 2007/0166223 | A1 | 7/2007 | Jiang et al. | |
| 2007/0284145 | A1 | 12/2007 | Scherer | |
| 2007/0284987 | A1 | 12/2007 | Liu et al. | |
| 2007/0293086 | A1 * | 12/2007 | Liu et al. | 439/578 |
| 2008/0095694 | A1 | 4/2008 | Nakayama et al. | |
| 2008/0170982 | A1 | 7/2008 | Zhang et al. | |

(Continued)

FOREIGN PATENT DOCUMENTS

| | | |
|---|---|---|
| CN | 1483667 | 3/2004 |
| CN | 1484275 | 3/2004 |

(Continued)

OTHER PUBLICATIONS

Li et al., Electroless Plating of Carbon Nanotube with Gold, Journal of Materials Science & Engineering, vol. 22, No. 1, pp. 48-51, Feb. 2004. Passage 2 of Left Column of p. 48 and Paragraph 3.2 of pp. 49-50 may be relevant.

(Continued)

*Primary Examiner* — Chau Nguyen
(74) *Attorney, Agent, or Firm* — Altis Law Group, Inc.

(57) ABSTRACT

A coaxial cable includes a core, an insulating layer, a shielding layer, and a sheathing layer. The core includes a carbon nanotube wire-like structure and at least one conductive material layer is disposed on the outside surface of the carbon nanotube wire-like structure. The carbon nanotube wire-like structure includes a plurality carbon nanotubes orderly arranged.

16 Claims, 7 Drawing Sheets

(56) References Cited

U.S. PATENT DOCUMENTS

| | | | | |
|---|---|---|---|---|
| 2009/0208708 | A1 | 8/2009 | Wei et al. | |
| 2009/0208742 | A1 * | 8/2009 | Zhu et al. | 428/367 |
| 2009/0212430 | A1 | 8/2009 | Wyland | |
| 2010/0297441 | A1 | 11/2010 | Zhu | |

FOREIGN PATENT DOCUMENTS

| | | | |
|---|---|---|---|
| CN | 1948144 | | 4/2007 |
| CN | 1982209 | | 6/2007 |
| CN | 1992099 | | 7/2007 |
| CN | 101003909 | | 7/2007 |
| CN | 101090011 | A | 12/2007 |
| JP | 2004-107196 | | 4/2004 |
| JP | 2004-342494 | | 12/2004 |
| JP | 2005-96024 | | 4/2005 |
| JP | 2005-235409 | | 9/2005 |
| JP | 2005-235429 | | 9/2005 |
| JP | 2005-302309 | | 10/2005 |
| JP | 2006-147170 | | 6/2006 |
| JP | 2007-536434 | | 12/2007 |
| JP | 2008-517182 | | 5/2008 |
| JP | 2008-519454 | | 6/2008 |
| TW | 200713384 | | 4/2007 |
| TW | 200724486 | | 7/2007 |
| TW | 200800798 | | 1/2008 |
| TW | 200802414 | | 1/2008 |
| TW | 200939252 | | 9/2009 |
| WO | W02005007926 | | 1/2005 |
| WO | W02005102924 | | 11/2005 |

OTHER PUBLICATIONS

Y.Zhang et al.Metal coating on suspended carbon nanotubes and its implication to metal-tube interaction,Chemical Physics Letters,Nov. 24, 2000,35-41,331,Elsevier Science.

Li Xia et al."Electroless Plating of Carbon Nanotube with Gold". Journal of Materials Science & Engineering,vol. 22 (2004);pp. 48-51.

* cited by examiner

COAXIAL CABLE

RELATED APPLICATIONS

This application is related to applications entitled, "METHOD FOR MAKING COAXIAL CABLE", U.S. patent application Ser. No. 12/321,573, filed Jan. 22, 2009; "CARBON NANUTUBE WIRE-LIKE STRUCTURE", U.S. patent application Ser. No. 12/321,568, filed Jan. 22, 2009; "METHOD FOR MAKING CARBON NANUTUBE TWISTED WIRE", U.S. patent application Ser. No. 12/321,551, filed Jan. 22, 2009; "CARBON NANUTUBE COMPOSITE FILM", U.S. patent application Ser. No. 12/321,557, filed Jan. 22, 2009; "METHOD FOR MAKING CARBON NANOTUBE FILM", U.S. patent application Ser. No. 12/321,570, filed Jan. 22, 2009; "COAXIAL CABLE", U.S. patent application Ser. No. 12/321,572, filed Jan. 22, 2009. The disclosures of the above-identified applications are incorporated herein by reference.

BACKGROUND

1. Technical Field

The present disclosure relates to coaxial cables and, particularly, to a coaxial cable incorporating carbon nanotubes.

2. Discussion of Related Art

Coaxial cables are generally used for transferring electrical power and signals. A typical coaxial cable includes a core, an insulating layer disposed at the outside surface of the core, and a shielding layer disposed at the outside surface of the insulating layer, and a sheathing layer disposed at the outside surface of the shielding layer. The core includes at least one conducting wire. The conducting wire may be a solid wire, a braided-shaped wire, or the like. The shielding layer may, for example, be a wound foil, a woven tape, or a braid. However, since the conducting wire is made of metal, a skin effect will occur in the conducting wire because of eddy currents set up by alternating current. Thus, the effective resistance of the coaxial cable may become larger, thereby causing signal decay during transmission. Moreover, the conducting wire and the shielding layer made of metal have less strength because of its greater size. Therefore, the coaxial cable must have comparatively greater weight and diameter, which results in a difficulty to use.

Carbon nanotubes (CNTs) are novel carbonaceous material and have received a great deal of interest since the early 1990s. Carbon nanotubes have interesting and useful heat conducting, electrical conducting, and mechanical properties. Therefore, conducting wire made of a mixture of carbon nanotubes and metal has been developed. However, the typical carbon nanotubes in the conducting wire are arranged disorderly. Thus, the above-mentioned skin effect still occurs.

What is needed, therefore, is a coaxial cable having good conductivity, high mechanical performance, lightweight and with small diameter to overcome the aforementioned shortcomings.

BRIEF DESCRIPTION OF THE DRAWINGS

Many aspects of the present coaxial cable can be better understood with references to the accompanying drawings. The components in the drawings are not necessarily drawn to scale, the emphasis instead being placed upon clearly illustrating the principles of the present coaxial cable and method for making the same.

Figure 1:
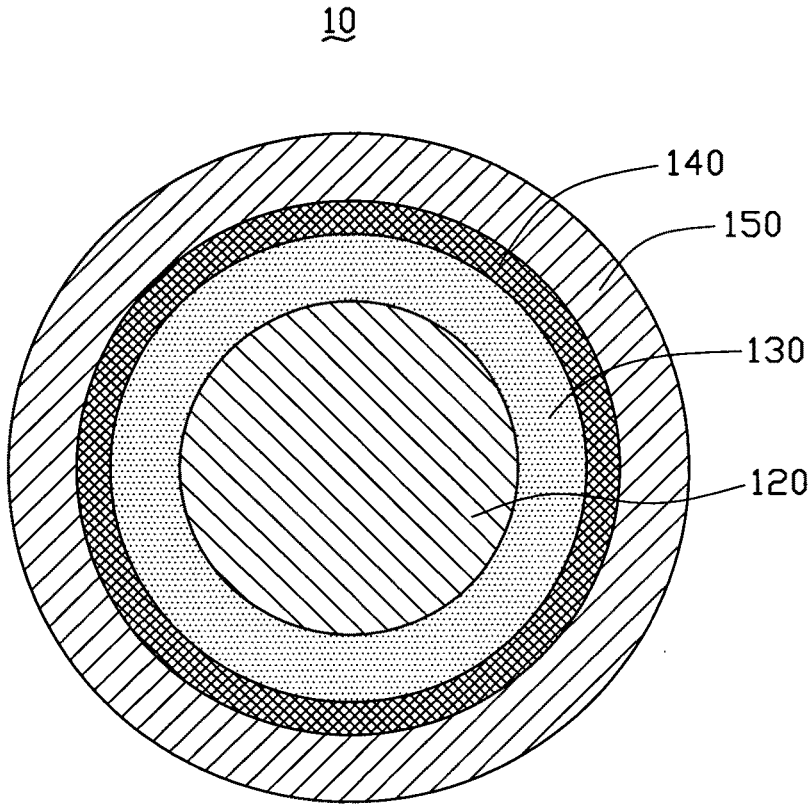
FIG. 1 is a schematic, cross-sectional view of a coaxial cable employed with a single core having carbon nanotube wire-like structure, in accordance with a first embodiment.

Corresponding reference characters indicate corresponding parts throughout the several views. The exemplifications set out herein illustrate at least one embodiment of the present coaxial cable and method for making the same, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present coaxial cable.

Referring to FIG. 1, a coaxial cable 10 according to a first embodiment includes a core 120, an insulating layer 130, a shielding layer 140, and a sheathing layer 150. The insulating layer 130 wraps the core 120. The shielding layer 140 wraps the insulating layer 130. The sheathing layer 150 wraps the shielding layer 140. The core 120, the insulating layer 130, the shielding layer 140, and the sheathing layer 150 are coaxial.

Figure 2:
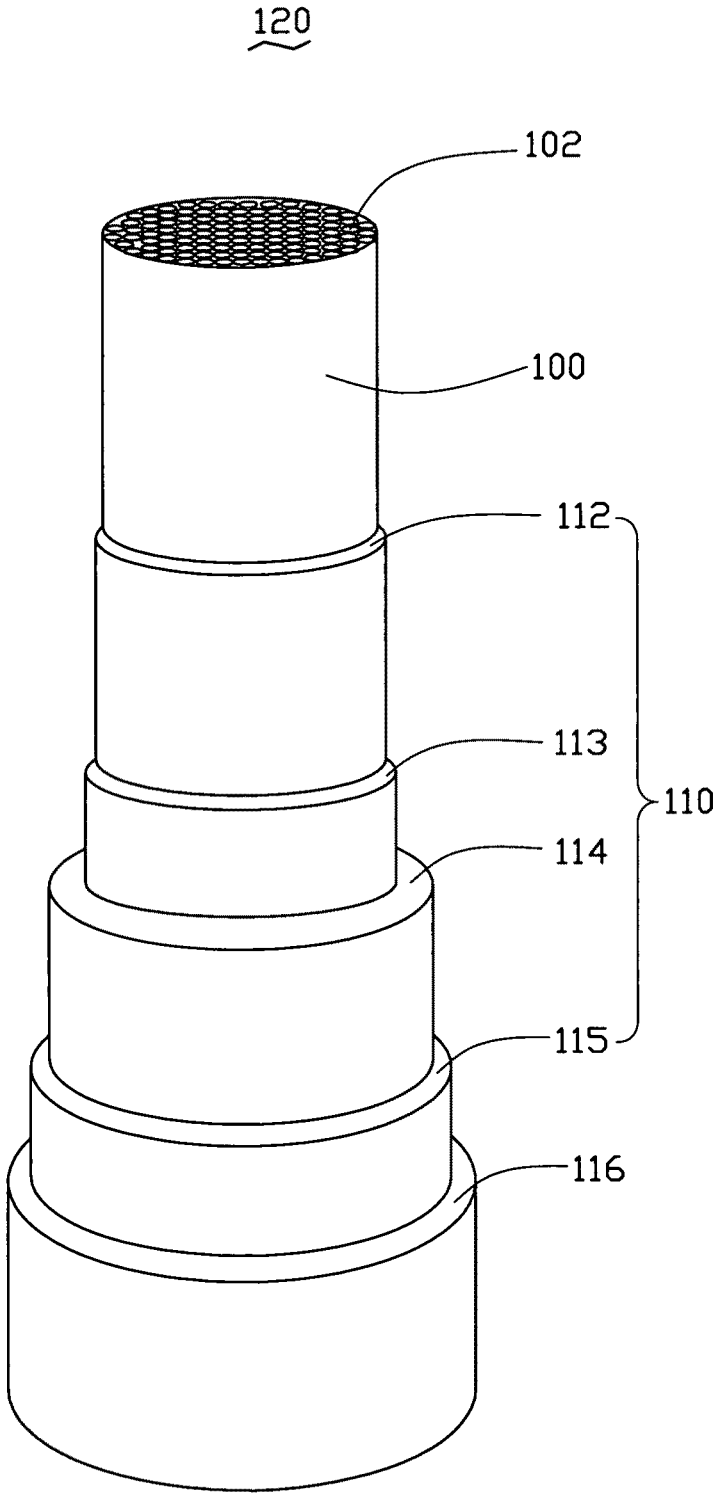
FIG. 2 is a schematic view of the single core of the coaxial cable of FIG. 1.

Referring also to FIG. 2, the core 120 includes a carbon nanotube wire-like structure 100, a conductive coating 110, and a strengthening layer 116. The conductive coating 110 wraps the carbon nanotube wire-like structure 100 and comprises at least one conductive layer 114. The strengthening layer 116 wraps the conductive coating 110. The carbon nanotube wire-like structure 100 includes one or a plurality of carbon nanotube wires 102. The diameter of the core 120 is about 10 microns to about 1 centimeter. Here, the carbon nanotube wire-like structure 100 includes a plurality of carbon nanotube wires 102 braided together and having a diameter of about 1 micrometers to about 1 centimeter.

Figure 3:
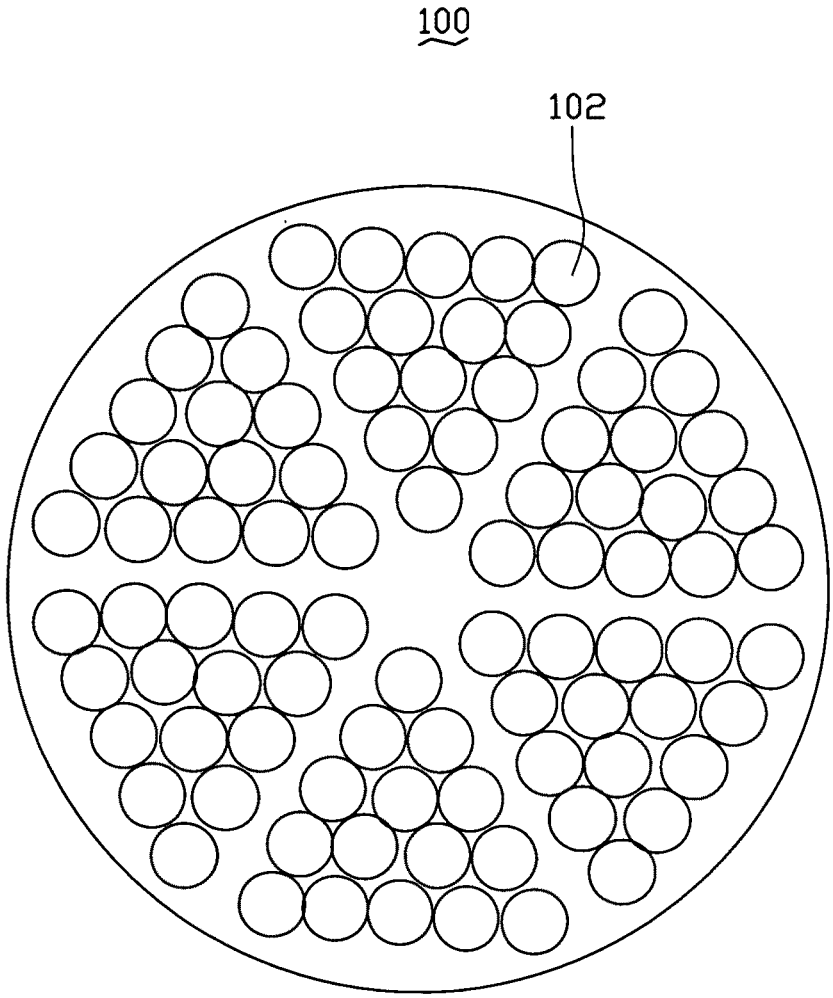
FIG. 3 is a schematic, cross-sectional view of the carbon nanotube wire-like structure of FIG. 1, wherein the carbon nanotube wire-like structure comprises a plurality of carbon nanotube wires.

Referring to FIG. 3, the carbon nanotube wires 102 may be twisted carbon nanotube wires, untwisted carbon nanotube wires, or any combinations thereof. Here, the carbon nanotube wires 102 are combinations of the twisted carbon nanotube wires and the untwisted carbon nanotube wires.

Figure 4:
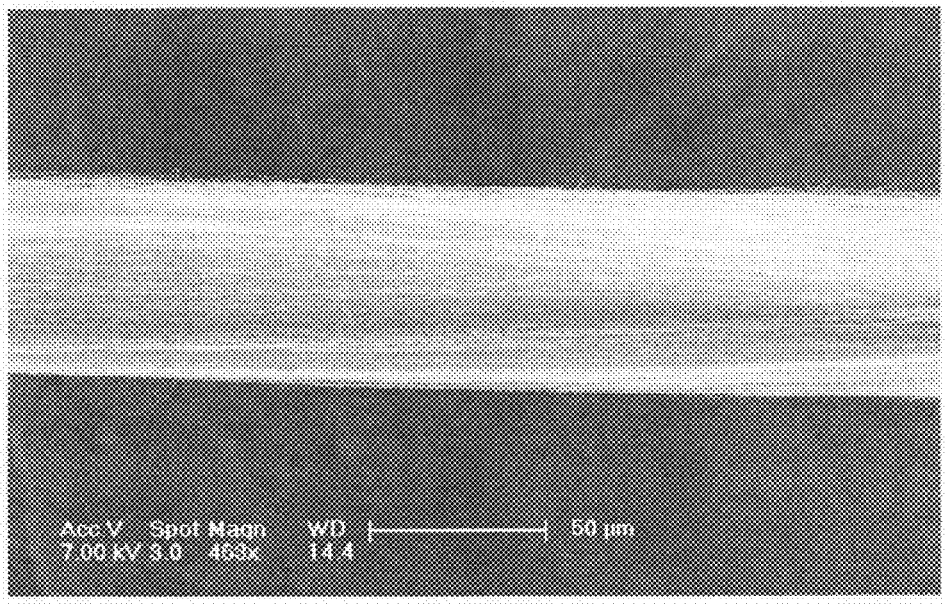
FIG. 4 is a Scanning Electron Microscope (SEM) image of an untwisted carbon nanotube wire when being employed by the carbon nanotube wire-like structure of FIG. 1.

Referring to FIG. 4, one untwisted carbon nanotube wire is shown. The untwisted carbon nanotube wire includes a plurality of carbon nanotubes segments having a plurality of carbon nanotubes substantially oriented along a same direction (i.e., a direction along the longitudinal axis of the untwisted carbon nanotube wire). The carbon nanotube segments can vary in width, thickness, uniformity and shape. The carbon nanotubes are parallel to the longitudinal axis of the untwisted carbon nanotube wire. The length of the untwisted carbon nanotube wire may be arbitrarily determined as desired. The diameter of the untwisted carbon nanotube wire can be from about 1 microns to about 1 centimeter.

Figure 5:
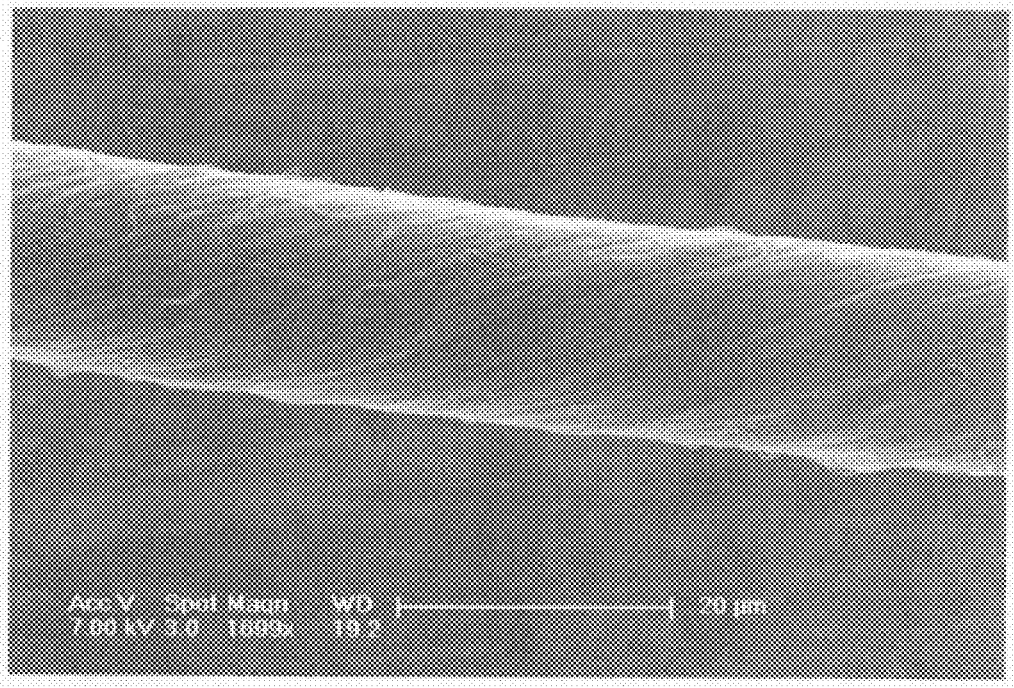
FIG. 5 is a SEM image of a twisted carbon nanotube wire when being employed by the carbon nanotube wire-like structure of FIG. 1.

Referring to FIG. 5, one twisted carbon nanotube wire is shown. The twisted carbon nanotube wire includes a plurality of carbon nanotubes oriented around a longitudinal axial direction thereof. The carbon nanotubes are aligned around the axis of the carbon nanotube twisted wire like a helix. The length of the carbon nanotube wire can be arbitrarily determined as desired. The diameter of the twisted carbon nanotube wire can be from about 1 microns to about 1 centimeter. The twisted carbon nanotube wire is formed by rotating the two ends of a carbon nanotube film in opposite directions using mechanical force or by other known means. Moreover, the twisted carbon nanotube wire can be treated with a volatile organic solvent. After being treated by the organic solvent, the adjacent and parallel carbon nanotubes of the twisted carbon nanotube wire may bundle up together, because of the surface tension of the organic solvent when the organic solvent volatilizing. The surface area of the twisted carbon nanotube wire may decrease, because the twisted carbon nanotubes in the carbon nanotube wire may bundle up together. The density and strength of the twisted carbon nanotube wire may be increased, because of bundling of the twisted carbon nanotube wire.

Referring to FIG. 2, the conductive coating 110 can further includes a wetting layer 112, a transition layer 113, a conductive layer 114, an anti-oxidation layer 115. As mentioned above, the conductive coating 110 has at least one conductive layer 114. Here, the conductive coating includes all of the aforementioned elements. The wetting layer 112 covers and wraps the carbon nanotube wire-like structure 100. The transition layer 113 covers and wraps the wetting layer 112. The conductive layer 114 covers and wraps the transition layer 113. The anti-oxidation layer 115 covers and wraps the conductive layer 114.

Since wettability between the carbon nanotubes and most kinds of metal is typically poor, the wetting layer 112 can be used to provide a good combination between the outer circumferential surface of carbon nanotube wire-like structure 100 and the conductive layer 114. The material of the wetting layer 112 can be selected from the group consisting of nickel (Ni), palladium (Pd), titanium (Ti), and any combinations thereof. A thickness of the wetting layer 112 is from about 0.1 nanometer to about 10 nanometers. Here, the wetting layer 112 is made of Ni and has a thickness of about 2 nanometers. The use of a wetting layer is optional.

The transition layer 113 is configured for connecting the wetting layer 112 with the conductive layer 114. The material of the transition layer 113 can be combined with the material of the wetting layer 112 as well as the material of the conductive layer 114, such as copper (Cu), silver (Ag), or alloys thereof. The thickness of the transition layer 113 is from about 0.1 nanometer to about 10 nanometers. Here, the transition layer 113 is made of Cu and has the thickness of about 2 nanometers. The use of a transition layer is optional.

The conductive layer 114 is configured for enhancing the conductivity of the carbon nanotube twisted wire. The material of the conductive layer 114 can be selected from any suitable conductive material including the group consisting of Cu, Ag, gold (Au) and combination thereof. A thickness of the conductive layer 114 is from about 10 nanometers to about 5 millimeters. Here, the conductive layer 114 is Ag and has the thickness of about 15 nanometers.

The anti-oxidation layer 115 is configured for preventing the conductive layer 114 from being oxidized in the air during fabricating of the core 120, thereby further preventing reduction of the conductivity of the core 120. The material of the anti-oxidation layer 115 can be any suitable material including gold (Au), platinum (Pt), any other anti-oxidation metallic materials, or any combinations thereof. A thickness of the anti-oxidation layer 115 is from 1 nanometer to 10 microns. Here, the anti-oxidation layer 115 is made of Pt and has the thickness of about 2 nanometers. The use of an anti-oxidation layer is optional.

The strengthening layer 116 covers and wraps the conductive coating 110 for enhancing the strength of the core 120. The material of the strengthening layer 116 can be any suitable material including a polymer having high strength, such as polyvinyl acetate (PVA), polyvinyl chloride (PVC), polyethylene (PE), or paraphenylene benzobisoxazole (PBO). A thickness of the strengthening layer 116 is from about 0.1 micron to about 5 millimeters. Here, the strengthening layer 116 covers the outer surface of the anti-oxidation layer 115, and is made of PVA, and has a thickness of about 0.5 microns. The use of a strengthening layer is optional.

The insulating layer 130 is configured for insulating the core 120 from the shielding layer 140. A material of the insulating layer 130 can be selected from the group consisting of polytetrafluoroethylene, polyethylene, polypropylene, polystyrene, polyethylene foam, and nano-clay-polymer composite material. Here, the material of the insulating layer 130 is polyethylene foam.

The shielding layer 140 is configured for shielding electromagnetic signals to avoid interference coming from exterior factors and is made of electrically conductive material. The shielding layer 140 can be formed by woven wires or by winding films. The woven wires may be metal wires, carbon nanotube wires, composite wires having carbon nanotubes, or the like. The winding films may be metal films, carbon nanotube films having carbon nanotubes, a composite film having carbon nanotubes, or the like. The carbon nanotubes in the carbon nanotube film are arranged in an orderly manner or in a disorderly manner. Here, the shielding layer 140 includes a plurality of carbon nanotube films.

A material of the metal wires or metal films can be selected from the group consisting of copper, gold, silver, other metals and their alloys having good electrical conductivity. The composite film can be composed of metals and carbon nanotubes, polymer and carbon nanotubes, polymer and metals. The material of the polymer can be selected from the group consisting of polyethylene Terephthalate (PET), polycarbonate (PC), acrylonitrile-Butadiene Styrene Terpolymer (ABS), polycarbonate/acrylonitrile-butadiene-styrene (PC/ABS) polymer materials, and other suitable polymer. When the shielding layer 140 is a composite film having carbon nanotubes, the shielding layer 140 can be formed by dispersing carbon nanotubes in a solution of the composite to form a mixture, and coating the mixture on the insulating layer 130. The shielding layer 140 comprises at least one layer formed by the wires or films or combination thereof.

The sheathing layer 150 is configured for protecting the coaxial cable 10 and is made of insulating material. Here, the sheathing layer 150 can be made of composite materials of nano-clay and polymer. The nano-clay may be nano-kaolin clay or nano-montmorillonite. The polymer may be silicon resin, polyamide, polyolefin, such as polyethylene, polypropylene, or the like. The composite material has good mechanical property, fire-resistant property, which therefore can provide protection the shielding layer 140 from damage of machinery, chemical exposure, etc.

Figure 6:
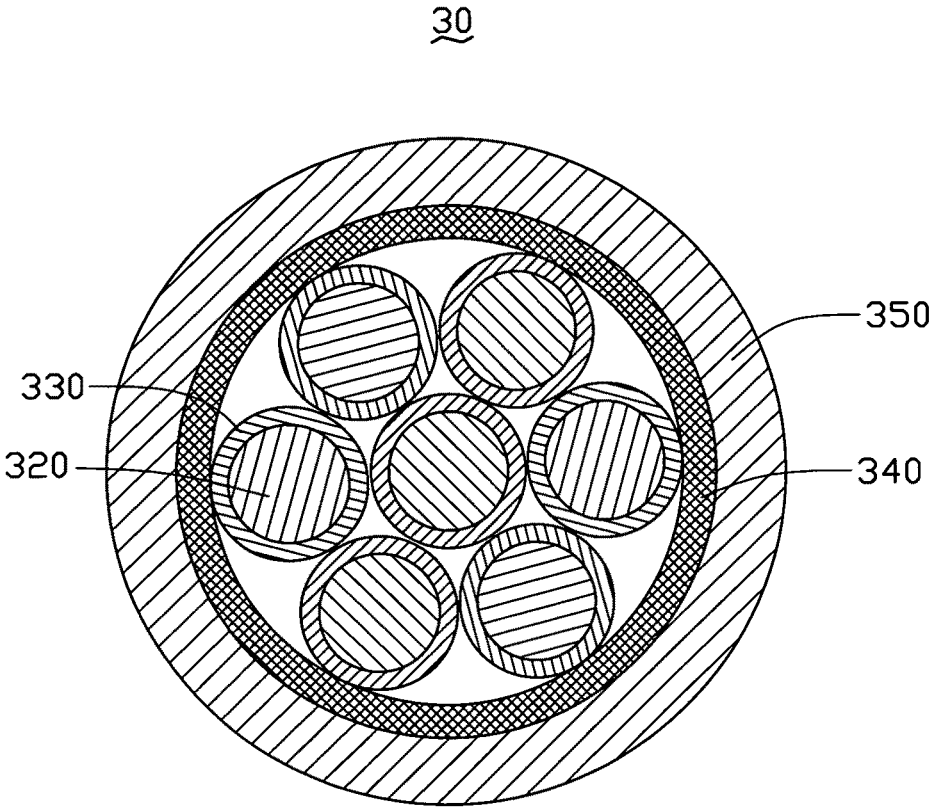
FIG. 6 is a schematic, cross-sectional view of a coaxial cable, in accordance with a second embodiment.

Referring to FIG. 6, a coaxial cable 30 according to a second embodiment is shown. The coaxial cable 30 includes a plurality of cores 320, a plurality of insulating layers 330, a shielding layer 340, and a sheathing layer 350. Each core 320 is wrapped by a corresponding insulating layer 330. The shielding layer 340 wraps the plurality of insulating layers 330 therein. The sheathing layer 350 wraps the shielding layer 340. Between the shielding layer 340 and the insulating layer 330, insulating material is filled.

Figure 7:
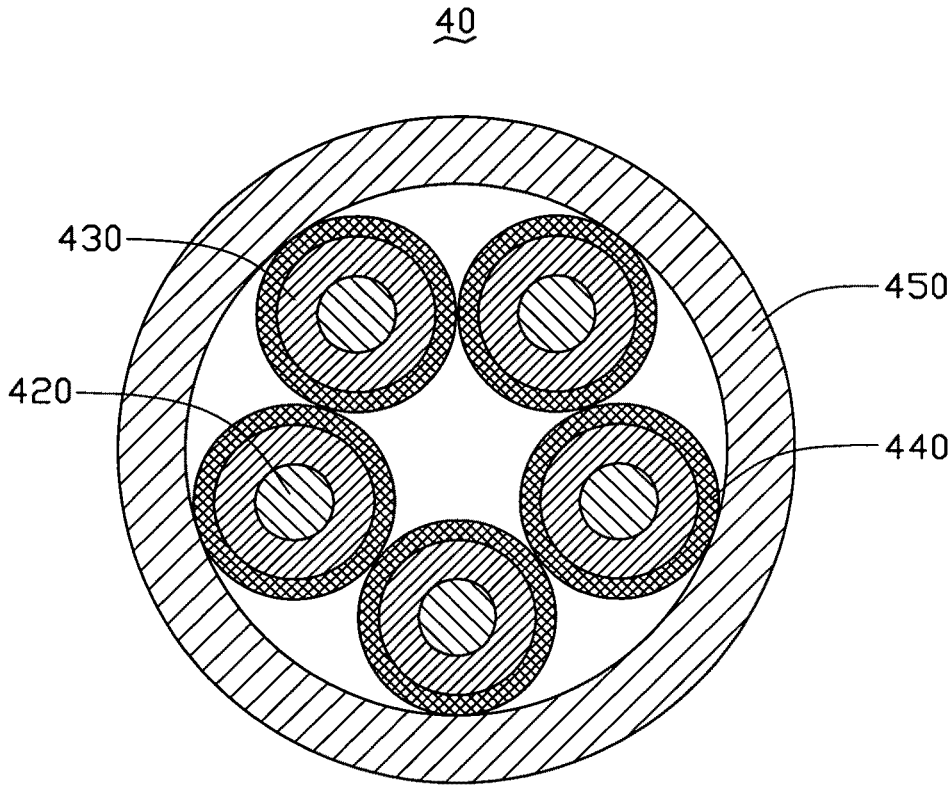
FIG. 7 is a schematic, cross-sectional view of a coaxial cable, in accordance with a third embodiment.

Referring to FIG. 7, a coaxial cable 40 according to a third embodiment is shown. The coaxial cable 40 includes a plurality of cores 420, a plurality of insulating layers 430, a plurality of shielding layers 440, and a sheathing layer 450. Each insulating layer 430 wraps a corresponding core 420. Each insulating layer 430 is wrapped by a corresponding shielding layer 440.

Here, each shielding layer 440 can shield each core 420. The shielding layers 440 are configured to avoid interference coming from outside factors, and avoid interference amongst the cores of the plurality of cores 420.

The coaxial cable 10, 30, 40 provided in the embodiments has the following superior properties. Since the core of the coaxial cable 10, 30, 40 include a carbon nanotube wire-like structure 100 and at least one layer of the conductive material. The carbon nanotube wire-like structure includes a plurality of carbon nanotubes orderly arranged, and a thickness of the at least one layer of the conductive material is just several nanometers, thus a skin effect less likely to occur in the coaxial cable 10, 30, 40, and signals will not decay as much during transmission. Since the carbon nanotubes have a small diameter, and the cable includes a plurality of carbon nanotubes and at least one layer of conductive material thereon, thus the coaxial cable 10, 30, 40 has a smaller width than a metal wire formed by a conventional wire-drawing method and can be used in ultra-fine (thin) cables.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A coaxial cable comprising:

a core comprising a carbon nanotube wire-like structure and at least one conductive coating wrapping the carbon nanotube wire-like structure, wherein the carbon nanotube wire-like structure comprises at least one carbon nanotube wire;

an insulating layer wrapping the core;

a shielding layer wrapping the insulating layer; and a sheathing layer wrapping the shielding layer, wherein the core further comprises a strengthening layer wrapping the at least one conductive coating, the strengthening layer comprises a material selected from the group consisting of polyvinyl acetate, polyvinyl chloride, polyethylene, paraphenylene benzobisoxazole, and combinations thereof.

2. The coaxial cable as claimed in claim 1, wherein the at least one carbon nanotube wire comprises a plurality of carbon nanotubes orderly arranged.

3. The coaxial cable as claimed in claim 2, wherein the at least one carbon nanotube wire is an untwisted carbon nanotube wire, the carbon nanotubes in the untwisted carbon nanotube wire are aligned along an axial direction of the untwisted carbon nanotube wire.

4. The coaxial cable as claimed in claim 2, wherein the at least one carbon nanotube wire is a twisted carbon nanotube wire, the carbon nanotubes in the twisted carbon nanotube wire are aligned helically around an axial direction of the twisted carbon nanotube wire.

5. The coaxial cable as claimed in claim 2, wherein the carbon nanotubes in the at least one carbon nanotube wire have an approximately same length and are joined end-to-end by Van der Waals attractive force therebetween.

6. The coaxial cable as claimed in claim 2, wherein a diameter of the at least one carbon nanotube wire is from about 4.5 nanometers to about 100 microns.

7. The coaxial cable as claimed in claim 2, wherein the at least one carbon nanotube wire-like structure comprises a plurality of carbon nanotube wires braided together.

8. The coaxial cable as claimed in claim 1, wherein the at least one conductive coating comprises a conductive layer.

9. The coaxial cable as claimed in claim 8, wherein the conductive layer comprises a material selected from the group consisting of copper, silver, gold and alloys thereof.

10. The coaxial cable as claimed in claim 8, wherein the at least one conductive coating further comprises a wetting layer between the outside surface of the carbon nanotube wire-like structure and the conductive layer, the wetting layer comprises a material selected from the group consisting of nickel, palladium, titanium, and alloys thereof.

11. The coaxial cable as claimed in claim 10, wherein the at least one conductive coating further comprises a transition layer between the wetting layer and the conductive layer, the transition layer comprises a material selected from the group consisting of copper, silver and alloys thereof.

12. The coaxial cable as claimed in claim 8, wherein the at least one conductive coating further comprises an anti-oxidation layer wrapping the conductive layer, the anti-oxidation layer comprises of a material selected from the group consisting gold, platinum and alloys thereof.

13. The coaxial cable as claimed in claim 1, wherein material of the shielding layer is selected from the group consisting of metals, carbon nanotubes, composite having carbon nanotubes, composite having metals, and combinations thereof.

14. The coaxial cable as claimed in claim 13, wherein the shielding layer comprises at least one wire, at least one film or combinations thereof.

15. The coaxial cable as claimed in claim 14, wherein the shielding layer comprises at least one metal wire, at least one metal film, at least one carbon nanotube wire, at least one carbon nanotube film, at least one composite carbon nanotube film, at least one composite carbon nanotube wire, or combinations thereof.

16. A coaxial cable comprising:

a core comprising a carbon nanotube wire-like structure and at least one conductive coating wrapping the carbon nanotube wire-like structure, wherein the carbon nanotube wire-like structure comprises a plurality of carbon nanotubes orderly arranged;

an insulating layer wrapping the core;

a shielding layer wrapping the insulating layer; and a sheathing layer wrapping the shielding layer;

wherein the at least one conductive coating comprises a conductive layer;

wherein the at least one conductive coating further comprises a wetting layer between the outside surface of the carbon nanotube wire-like structure and the conductive layer, the wetting layer comprising a material selected from the group consisting of nickel, palladium, titanium, and alloys thereof;

wherein the at least one conductive coating further comprises a transition layer between the wetting layer and the conductive layer, the transition layer comprising a material selected from the group consisting of copper, silver, and alloys thereof.

* * * * *